US005388377A

United States Patent [19]

Faulkner

[11] Patent Number: 5,388,377

[45] Date of Patent: Feb. 14, 1995

[54] GUTTER ASSEMBLY FOR ROOFS

[76] Inventor: Charles L. Faulkner, 15819 Fox Springs Dr., Houston, Tex. 77084

[21] Appl. No.: 137,726

[22] Filed: Oct. 18, 1993

[51] Int. Cl.[6] ..... E04D 13/00

[52] U.S. Cl. ..... 52/11; 52/12

[58] Field of Search ..... 52/11, 12, 94; 248/48.2, 48.1

[56] References Cited

U.S. PATENT DOCUMENTS 5,007,224 4/1991 Segneri ..... 52/11 X 5,181,350 1/1993 Meckstroth ..... 52/12

*Primary Examiner*—Carl D. Friedman

*Assistant Examiner*—Creighton Smith

*Attorney, Agent, or Firm*—Bush, Moseley, Riddle & Jackson

[57] ABSTRACT

A gutter assembly (10) for a roof including a gutter (26), a plurality of spaced hangers (28), and a leaf screen (32) over the gutter (26). Lag bolts (78) are mounted at an angle to the horizontal through aligned openings (76) in the hangers (28) and extend through the fascia board (20) into a rafter (16) or a joist (18). An embodiment shown in FIG. 4 has a removable strip (27A) for fitting on an existing gutter and having a slot (46A) to receive a leaf screen (32A). Another embodiment shown in FIGS. 5 and 6 provides hanger brackets (82) on a downspout (80) for mounting on screws (98) secured to a support wall.

8 Claims, 3 Drawing Sheets

FIG. 5
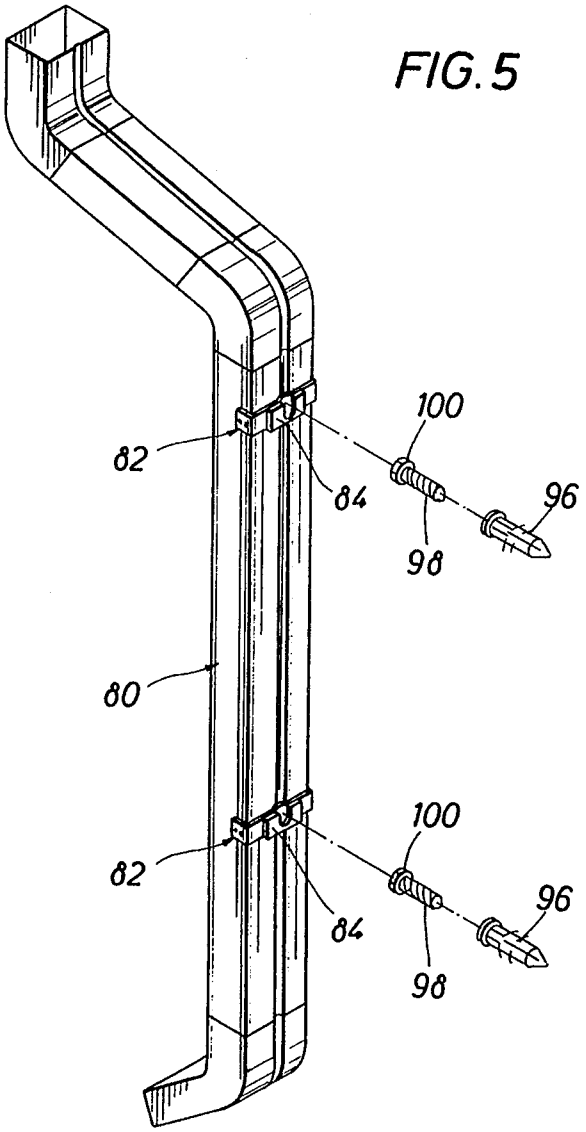
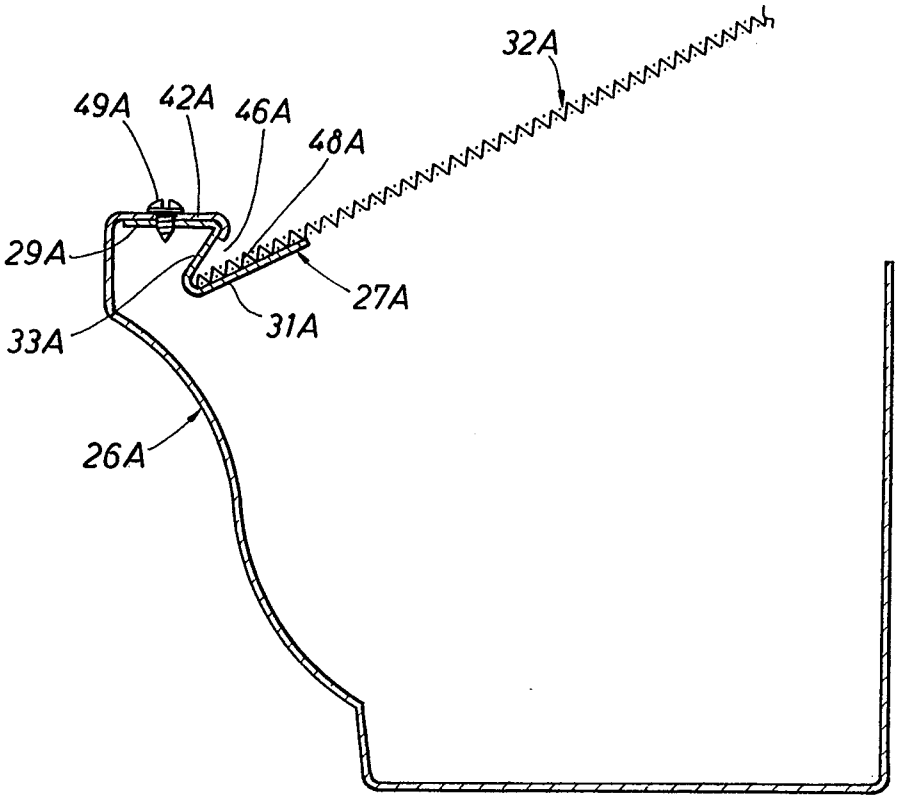
FIG. 4

GUTTER ASSEMBLY FOR ROOFS

FIELD OF THE INVENTION

This invention relates to a gutter assembly for roofs and more particularly to a gutter or eaves trough assembly including a plurality of hangers for mounting the gutters.

BACKGROUND OF THE INVENTION

Heretofore, various types of mountings have been provided for mounting gutters beneath a shingled roof. For example, a plurality of horizontally spaced hangers have been secured to a fascia board beneath the shingled roof to support the gutter. U.S. Pat. No. 5,040,750 dated Aug. 20, 1991 utilizes a plurality of hangers to support a gutter with the hangers having opposed slots to removably receive a leaf screen. Hangers for supported gutters are normally cantilevered outwardly from the fascia board and are usually secured to the fascia board by gutter spikes, nails or screws. The nails, screws or gutter spikes oftentimes tend to pull away from the fascia board after extended use, particularly during heavy rain downpours or when downspouts are blocked. Also, at times the fascia board tends to pull away from a rafter or header board to which it is attached under such conditions resulting from the cantilevered weight of the gutters extending outwardly from the fascia board.

Leaf means or guards are desired to minimize clogging of gutters and downspouts from the accumulation of leaves and other natural debris from trees and the like. The purpose of the leaf guards or screens is to prevent the passage of water into the gutters while straining from the water any leaves, sticks and other objects which might clog the gutters and downspouts to block the passage of water. Leaf screens have been formed of wire screen, woven wire, expanded metal, molded plastic and other materials, for example. It is desirable to mount a wire screen on the gutter so that the screen may be easily removed, if desired, for access to the inside of the gutter. U.S. Pat. No. 4,965,969 dated Oct. 30, 1990 shows a gutter guard or screen which has an upper edge fitting beneath the shingle and a lower edge removably secured to the gutter by clips. U.S. Pat. No. 2,284,440 dated May 26, 1942 shows a somewhat similar arrangement in which a leaf screen is secured by removable ties or clips.

SUMMARY OF THE INVENTION

The present invention is particularly directed to a gutter assembly having a gutter supported by a plurality of horizontally spaced hangers from the facia board extending beneath shingles of a sloping roof. Each hanger has an upper edge portion for fitting against the fascia board and includes a sloping outer surface for receiving upwardly inclined lag bolts to secure the gutters to the facia board and adjacent rafters or headers. The lag bolts also extend through a rear portion of the gutter and a flashing member behind the gutter for mounting the entire gutter assembly to the fascia board.

The gutter assembly of this invention is adapted to receive a leaf screen thereon and includes an embodiment directed to a retrofit to permit existing gutters to have a leaf screen mounted therein. The leaf screen has an upper edge portion positioned beneath the roof shingles and a lower edge portion positioned within a supporting slot or groove on an upper outer edge portion of the gutter.

Another feature of the gutter assembly of this invention includes a downspout bracket or hanger for securing a downspout to the side of a house or building. The downspout hangers have a central notch for receiving a screw therein and are first secured to the downspout prior to installation of the downspouts. A plurality of screws are positioned on the adjacent wall of the supporting house or building, and then the downspout is positioned on the wall with the screws being received within the notches of the hanger. By mounting the downspouts in this manner, the downspouts may be easily removed for repair, cleaning or painting, and then may be reinstalled.

Other features, objects and advantages of this invention will become more apparent after referring to the following specification and drawings.

BRIEF DESCRIPTION OF DRAWINGS

FIG. 4 is a sectional view of another embodiment of this invention showing a removable attachment for existing gutters for retrofitting existing gutters with leaf screens;

FIG. 5 is a perspective view of a downspout having downspout brackets secured thereto to secure screws mounted on an existing vertical supporting surface to permit installation and removal of the downspout.

DESCRIPTION OF THE INVENTION

Figure 1:
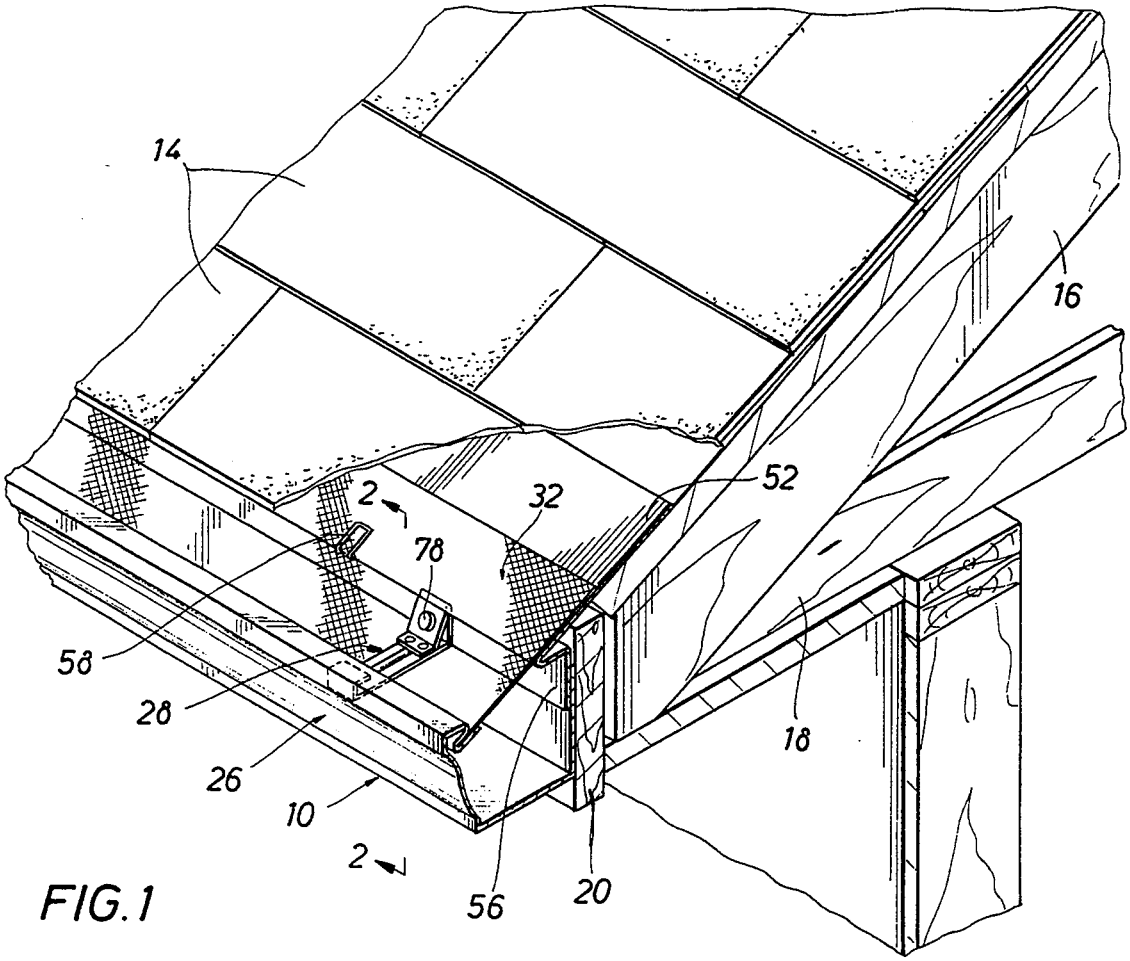
FIG. 1 is a perspective of a portion of the gutter, eave and roof area of a building structure showing a gutter assembly in accordance with the present invention.
Figure 2:
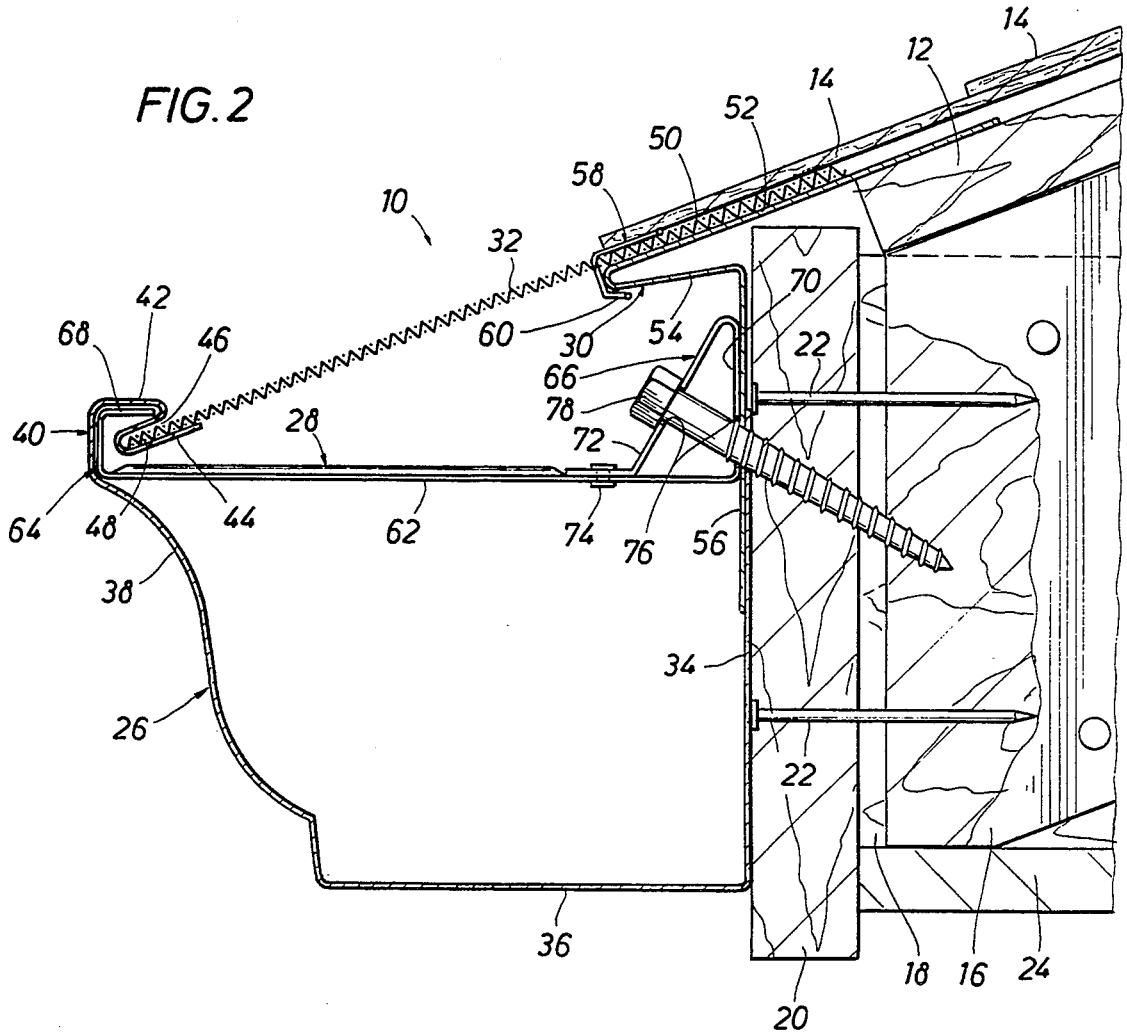
FIG. 2 is a section taken generally along line 2—2 of FIG. 1.
Figure 3:
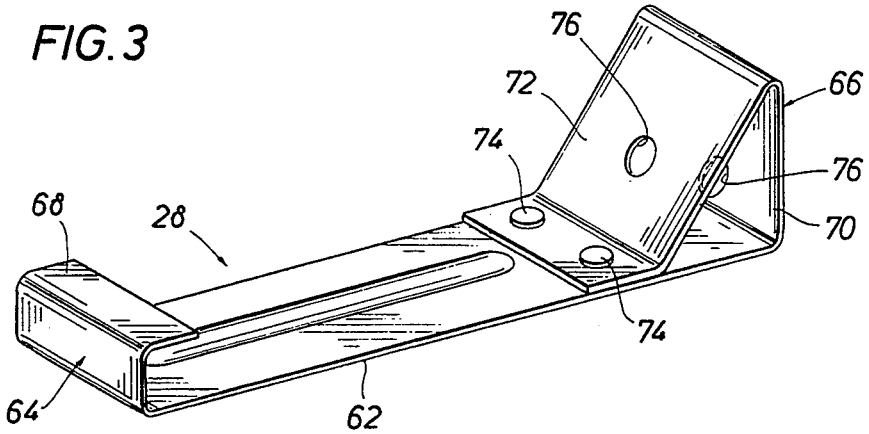
FIG. 3 is a perspective of the hanger for the gutter as shown in FIGS. 1 and 2.

Referring now particularly to FIGS. 1–3, the gutter assembly of the present invention is shown generally at 10 attached to the roof area of a building, such as a home. The roof area includes roof decking 12, such as plywood sheets, and shingles 14 secured to decking 12. A sloping roof rafter 16 extends beneath decking 12 and a horizontal leader or joint 18 is connected to the lower end of rafter 16. A fascia board 20 is secured by nails 22 to joints 18. A soffit 24 extends between fascia board 20 and the outer wall of the building.

Gutter assembly 10 includes a gutter generally indicated at 26, a plurality of spaced hangers 28, a metal flashing strip generally indicated at 30, and a leaf screen 32 over gutter 26. Gutter 26 has a rear vertical side portion 34 adjacent fascia board 20, a bottom 36, and a front side portion 38. Front side portion 38 has an upper edge portion generally designated 40 defining an upper horizontal flange 42 having a downturned free end portion 44 forming a groove or slot at 46. Leaf screen 32 has a lower marginal edge portion 48 fitting within slot 46 and an upper marginal edge portion 50 fitting beneath shingles 14.

Metal flashing strip 30 has an upper inclined portion 52 extending between roof decking 12 and shingles 14 outwardly to a position adjacent the lower extending end of the roof. Metal strip 30 then loops inwardly at 54 to fascia board 20 and a lower vertical portion 56 extends downwardly along fascia board 20 to overlap rear portion 34 of gutter 26. In this relation, water flowing over the rear of gutter 26 will not contact fascia board 20 or roof decking 12 as flashing strip 30 will deflect the water downwardly into gutter 26.

To hold leaf screen 32 in position within slot or groove 46, a plurality of clips generally indicated at 58 each has a pair of prongs 60 which fit through leaf screen 32 and under the loop formed at 54 by flashing strip 30 as shown in FIG. 2. Clips 58 may be spaced as desired along flashing strip 30.

Hangers 28 are spaced horizontally along the length of gutter 26 for securement of gutter assembly 10 to fascia board 20. Each hanger 28 has a base 62, an upwardly extending front edge portion 64, and an upwardly extending rear edge portion 66. Front edge portion 64 is of a channel shape having an upper flange 68 fitting beneath flange 42 of upper edge portion 40 for gutter 26. Upper edge portion 40 fits about front edge portion 64 of hanger 28 for support therefrom.

Rear edge portion 66 includes a vertical rear side 70 and an inclined downturned mounting flange 72 secured to base 62 at 74. Openings 76 in rear side 70 and inclined flange 72 are axially aligned at an angle of around 30 degrees to base 62. A lag bolt 78 is received within openings 76 for threading through flashing strip 30 and rear side portion 34 of gutter 26 which are formed of a relatively thin sheet-metal material. Then lag bolt 78 is threaded into fascia board 20 and either rafter 16 or joist 18. Since lag bolt 78 is threaded at a 30 degree angle to the horizontal, any cantilevered loads from the weight of gutter 26 and waste or debris therein is resisted by lag bolt 78 and lag bolt 78 does not tend to pull away from fascia board 20 even after prolonged use.

Referring to FIG. 4, a separate embodiment of this invention is shown for attachment of a leaf screen 32A to an existing gutter 26A. Gutter attachment 27A comprises a metal strip of a generally Z-shape defining an upper securing flange 29A and a lower supporting flange 31A connected by an intermediate web 33A. A slot 46A is formed between web 33A and lower supporting flange 31A to receive lower marginal edge portion 48A of leaf screen 46A in supporting relation. Screws 49A connect gutter attachment 27A to upper flange 42A of gutter 26A at locations between hangers. It may be desirable, under certain conditions, to provide blind rivets instead of screws 49A to mount gutter attachment 27A. Gutter attachment 27A is adapted to fit a majority of existing gutters and hangers. Thus, existing gutters can be easily retrofitted with a leaf screen with the arrangement shown in FIG. 4.

Figure 6:
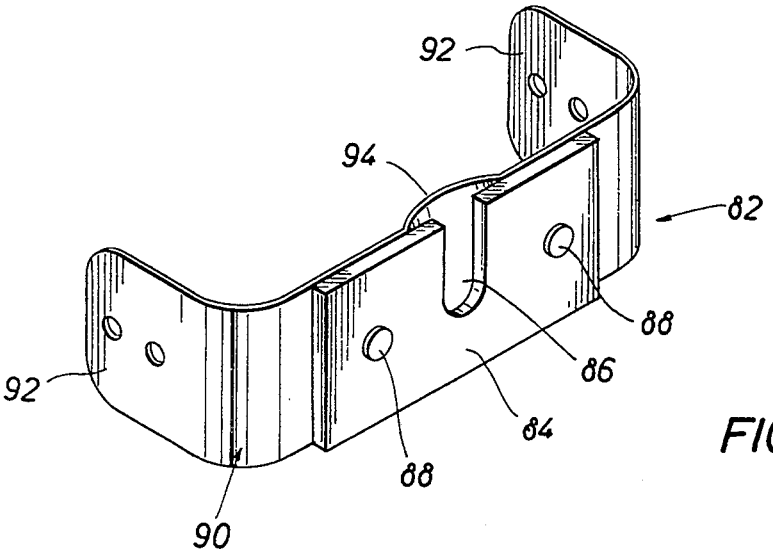
FIG. 6 is an enlarged perspective of a downspout bracket removed from the downspout.

Referring to FIGS. 5 and 6, an attachment for a downspout is illustrated to permit a downspout to be easily installed and removed, such as may be desirable for repair, cleaning, or painting, for example, and then easily reinstalled. Downspout 80 has a plurality of hanger brackets 82 secured thereon. Each hanger bracket 82 has a base plate 84 with an upwardly directed slot 86 therein. Plate 84 is secured by suitable rivets 88 to a band 90 having side portions 92 secured to opposed sides of downspout 80 by suitable screws or rivets. Band 90 is bowed at 94 away from plate 84 at slot 86 to permit the head of a screw or the like to be easily received within slot 86.

Prior to installation of downspout 80, a screw expander 96 is positioned within the supporting surface for downspout 80 such as a wooden or brick wall, for example, on a home or building. Then, screws 98 having heads 100 are threaded within expanders 96. Downspout 80 is then installed with slots 86 receiving screws 98. The upper end of downspout 80 is then secured, such as by a screw, to the gutter. It may be desirable to have slots 86 facing into a downward direction and in this relation, the weight of downspout 80 would be supported by screws 98.

It now will be recognized that a new and improved gutter assembly for roofs has been disclosed which meets all of the objectives of the present invention, and which incorporates numerous unique features and advantages as set forth herein. Since certain changes or modifications may be made in the disclosed embodiments without departing from the inventive concepts involved, it is the aim of the appended claims to cover all such changes and modifications falling within the true spirit and scope of the present invention.

What is claimed is:

1. In combination with a roof having an outer roofing material overhanging a fascia board; a gutter assembly mounted on said fascia board comprising:

a plurality of horizontally spaced elongate gutter hangers mounted on said fascia board and extending outwardly therefrom, each hanger having a base with upwardly extending rear and front edge portions, said upwardly extending rear edge portion of said hanger including a vertical rear side extending upwardly from said base and an integral downturned mounting flange extending downwardly from said vertical rear side in an inclined spaced relation thereto;

a gutter extending in a generally horizontal direction along said fascia board and having a rear portion thereof between said hangers and said fascia board; said gutter having a front side and an upper edge portion extending along said front side, said upper edge portion defining an inner support member facing toward said roofing material; and a fastener for each of said hangers extending through said vertical rear side and said downturned mounting flange into said fascia board for securing an associated hanger to said fascia board.

2. The combination as set forth in claim 1 wherein a rafter extends beneath said roof to said fascia board, and said fastener extends through said fascia board into said rafter for securement.

3. The combination as set forth in claim 1 wherein a metal flashing strip fits beneath said roofing material and extends downwardly therefrom alongside said fascia board between said rear portion of said gutter and said hanger, said fasteners securing said flashing to said fascia board.

4. In a gutter assembly adapted to be secured to a vertically extending support member extending beneath shingles of a sloping roof; said gutter assembly comprising:

a plurality of hangers secured to said vertically extending support member and spaced horizontally along said support member;

a gutter supported on said hangers having a portion adjacent said vertically extending support member and an opposed front portion, said front portion having an upper edge portion defining a groove facing inwardly toward said shingles; and a leaf screen having a lower marginal edge portion received within said groove and an upper marginal edge portion extending beneath said shingles; said upper edge portion having an inwardly extending generally horizontal flange and a separate longitudinally extending strip attached to said inwardly extending flange for supporting said leaf screen.

5. In a gutter assembly as set forth in claim 4 wherein said upper edge portion has an inwardly extending generally horizontal flange, and said strip is detachably connected to said flange.

6. In a gutter assembly as set forth in claim 4 wherein a metal flashing strip fits beneath said shingles and extends downwardly along said support member, said metal flashing extending outwardly beyond said support member and then extending inwardly to said support member.

7. In a gutter assembly adapted to be secured to a vertically extending support member extending beneath shingles of a sloping roof; said gutter assembly comprising:

a plurality of hangers secured to said vertically extending support member and spaced horizontally along said support member, each hanger having a base with upwardly extending rear and front edge portions, said upwardly extending rear edge portion of said hanger including a vertical rear side extending upwardly from said base and an integral downturned mounting flange extending downwardly from said vertical rear side in an outwardly inclined relation thereto;

a gutter supported on said hanger having a portion adjacent said vertically extending support member and an opposed front portion, said front portion having an upper edge portion defining a groove facing inwardly toward said shingles;

a leaf screen having a lower marginal edge portion received within said groove and an upper marginal edge portion extending beneath said shingles; and a fastener for each hanger extending through said vertical rear side and said downturned mounting flange into said vertically extending support member.

8. In combination with a roof having an outer roofing material overhanging a fascia board; a gutter assembly mounted on said fascia board comprising:

a plurality of horizontally spaced gutter hangers mounted on said fascia board and extending outwardly therefrom;

a gutter extending in a generally horizontal direction along said fascia board and having a rear portion thereof between said hangers and said fascia board; said gutter having a front side and an upper edge portion extending along said front side, said upper edge portion defining an inner support member facing toward said roofing material;

a fastener for each of said hangers securing an associated hanger to said fascia board; and a leaf screen having a lower marginal edge portion supported on said inner support member and an upper marginal edge portion supported on said roof; said upper edge portion having an inwardly extending generally horizontal flange and a longitudinally extending strip detachably connected to said inwardly extending flange and forming said inner support member for supporting said leaf screen.

* * * * *